US008947983B2

(12) United States Patent
Stark

(10) Patent No.: US 8,947,983 B2
(45) Date of Patent: Feb. 3, 2015

(54) DIAL FOR A TIMEPIECE

(71) Applicant: ETA SA Manufacture Horlogere Suisse, Grenchen (CH)

(72) Inventor: Stefan Stark, Preles (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 13/864,692

(22) Filed: Apr. 17, 2013

(65) Prior Publication Data

US 2013/0279304 A1 Oct. 24, 2013

(30) Foreign Application Priority Data

Apr. 20, 2012 (EP) ..... 12164997

(51) Int. Cl.
*G04B 19/06* (2006.01)
*G04B 19/10* (2006.01)

(52) U.S. Cl.
CPC ..... *G04B 19/06* (2013.01); *G04B 19/103* (2013.01)
USPC ..... 368/232; 368/236

(58) Field of Classification Search
USPC ..... 368/80, 228, 323, 236, 237, 232
See application file for complete search history.

(56) References Cited

U.S. PATENT DOCUMENTS

| | | | | |
|---|---|---|---|---|
| 1,310,523 A | | 7/1919 | Eberhard | |
| 2,606,418 A | * | 8/1952 | Fluckiger | 368/232 |
| 3,433,013 A | * | 3/1969 | Kohli et al. | 368/232 |
| 5,555,535 A | * | 9/1996 | Davis | 368/232 |
| 6,404,704 B1 | * | 6/2002 | Bossel et al. | 368/232 |
| 7,997,789 B2 | * | 8/2011 | Smith et al. | 368/278 |
| 8,540,419 B2 | * | 9/2013 | Winkler et al. | 368/285 |
| 2003/0012086 A1 | * | 1/2003 | Gressly et al. | 368/232 |
| 2007/0274160 A1 | * | 11/2007 | Behling et al. | 368/10 |

FOREIGN PATENT DOCUMENTS

| | | |
|---|---|---|
| CH | 260 123 | 2/1949 |
| CH | 393 191 | 2/1965 |
| CH | 419 978 | 5/1966 |
| EP | 0 257 453 A1 | 3/1988 |
| JP | 58-124979 | 7/1983 |
| JP | 2005-49277 | 2/2005 |

OTHER PUBLICATIONS

European Search Report issued Nov. 30, 2012, in European Patent Application No. 12164997.4, filed Apr. 20, 2012.

* cited by examiner

*Primary Examiner* — Sean Kayes
(74) *Attorney, Agent, or Firm* — Oblon, Spivak, McClelland, Maier & Neustadt, L.L.P.

(57) ABSTRACT

Dial (1) for a timepiece (100) comprising a front face (2) which forms a visible display surface and is opposite a back face (3), characterized in that the dial includes, either at least one cavity (4) extending into at least one portion of the thickness of said dial (1) between said visible surface (2) and said back surface (3), or at least one peripheral surface (40) extending into at least one portion of the thickness of said dial (1) between said visible surface (2) and said back surface (3). At least one said cavity (4) or at least one peripheral surface (40) includes at least one undercut surface (5), extending into at least one portion of the thickness of said dial (1) between said visible surface (2) and said back face (3).

19 Claims, 2 Drawing Sheets

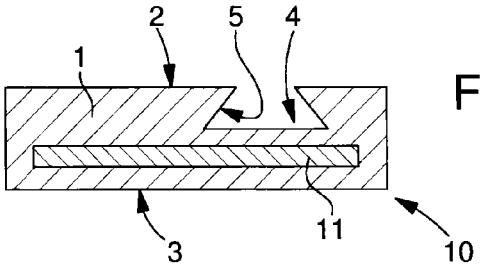
Fig. 13
Fig. 8
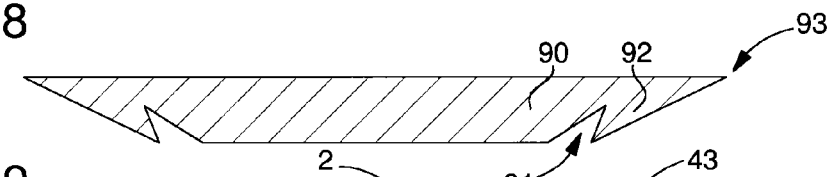
Fig. 9
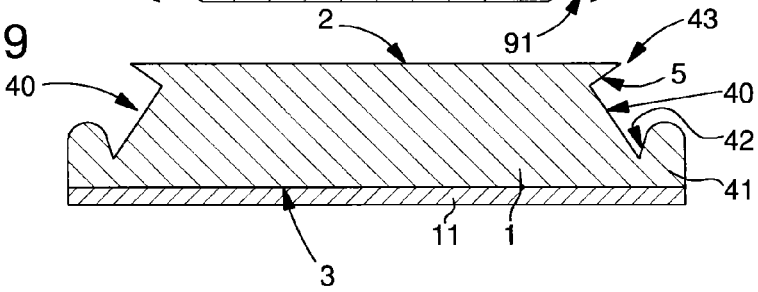
Fig. 10
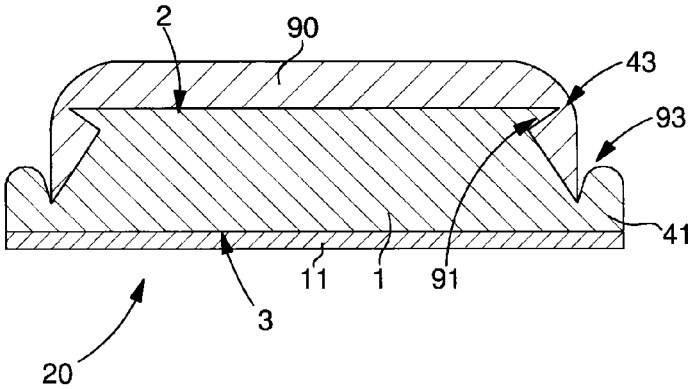
Fig. 11
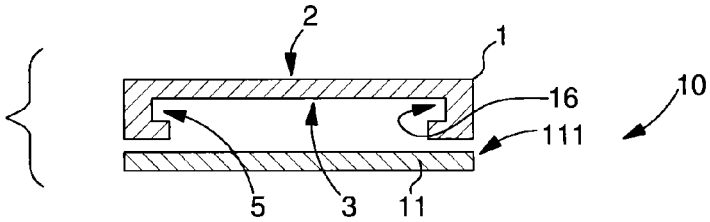
Fig. 12
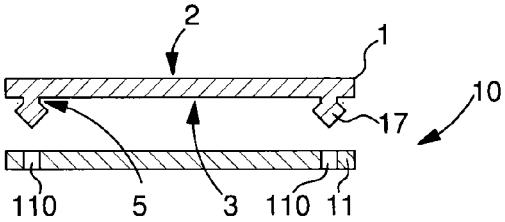

DIAL FOR A TIMEPIECE

This application claims priority from European Patent Application No. 12164997.4 filed Apr. 20, 2012, the entire disclosure of which is incorporated herein by reference.

FIELD OF THE INVENTION

The invention concerns a timepiece dial comprising a front face which forms a visible display surface and is opposite a back face comprising at least one cavity extending into at least one portion of the thickness of said dial between said visible surface and said back surface and comprising at least one undercut surface extending into at least one portion of the thickness of said dial between said visible surface and said back surface.

The invention also concerns a reinforced dial including at least one dial of this type.

The invention also concerns an equipped dial including at least one dial of this type or a reinforced dial of this type.

The invention also concerns a timepiece including at least one dial or reinforced dial of this type, or an equipped dial of this type.

The invention also concerns a method of making a dial of this type.

The invention concerns the field of timepieces, and more specifically the field of display or the field of decorating visible surfaces.

BACKGROUND OF THE INVENTION

Timepiece dials are made of rigid materials, in particular rigid synthetic materials, to ensure that the display has good resistance and the right appearance.

Moulding methods only allow for tapered surfaces, which restricts the possibility of developing details or even entire dials in relief. It is only possible to place inserts in cylindrical or tapered housings, which means that the inserts have to be bonded or crimped in their housings, to ensure that they are held and positioned properly, particularly in an angular position.

The only possible ways of obtaining undercut surfaces, for holding inserts or for obtaining particular optical effects, thus lie in stacking and bonding several layers or in expensive machining.

CH Patent Application No. 419 978A in the name of FLUCKIGER discloses a dial with notches having bevelled openings on the back, and elongated inserts with elastic lugs clipped thereto.

US Patent Application No. 1 310 523A in the name of EBERHARD discloses a dial with a base comprising conical inserts on the back, into which slit feet, comprised on the back of the display component, are clipped.

CH Patent Application No. 393 191A in the name of LE PRELET discloses a dial comprising slots, into which fitted signs, comprising feet and riveted to the back of the dial, are inserted in conical or bevelled openings.

EP Patent Application No. 0257 453A in the name of TISSOT discloses a single piece dial having a middle part made of natural mineral material, comprising housings in which cabochons containing cut stones are set.

CH Patent Application No. 260 123A in the name of BEYELER also discloses a dial with cut stones mounted in a cabochon or mounted through the back of the dial and held by undercut surfaces.

JP Patent Application No. 58 124979A in the name of SEIKO discloses the bonding of stones in cabochons, as an alternative to setting stones in cabochons.

JP Patent Application No. 2005 049277A in the name of KAWAGICHIKO SEIMITSU discloses a relief dial with moulded undercut surfaces, wherein the decoration of the display signs is achieved by pad printing in several stages.

SUMMARY OF THE INVENTION

The invention proposes to provide great freedom of design for dials, by allowing portions in relief with undercuts, for positioning inserts or obtaining particular types of relief.

More specifically, it is an object of the invention to propose a possible embodiment of this type of dial in a single piece.

The invention therefore concerns a timepiece dial comprising a front face which forms a visible display surface and is opposite a back face, comprising at least one cavity extending into at least one portion of the thickness of said dial between said visible surface and said back surface and comprising at least one undercut surface extending into at least one portion of the thickness of said dial between said visible surface and said back surface, characterized in that said dial is a single piece made of flexible material selected from among a flexible elastomer or a silicon or a rubber or a leather.

According to a particular feature of the invention, the dial includes at least one peripheral surface extending into at least one portion of the thickness of said dial between said visible surface and said back face, and said at least one peripheral surface includes at least one undercut surface, extending into at least one portion of the thickness of said dial between said visible surface and said back surface.

According to another particular feature of the invention, the dial is formed of a flexible elastomer or silicon.

The invention further concerns a reinforced dial including at least one dial of this type, characterized in that at least one said back face is fixed to a rigid sole.

The invention further concerns an equipped dial comprising at least one dial of this type or a reinforced dial of this type, characterized in that it includes at least one flexible or rigid insert comprising at least one tapered surface cooperating with one said undercut surface to hold said insert in said at least one dial.

The invention also concerns a timepiece including at least one dial or reinforced dial of this type, or an equipped dial of this type.

The invention also concerns a method of making a dial of this type, characterized in that:

- a mould is prepared comprising at least one relief surface including at least one undercut surface;
- a flexible material or silicon or flexible elastomer is moulded in a liquid or paste state in said mould;
- said flexible material or silicon or flexible elastomer is left in said mould for a sufficient time to achieve polymerisation or vulcanisation until an ambient temperature stable dial is obtained;
- said dial is removed from the mould.

BRIEF DESCRIPTION OF THE DRAWINGS

Other features and advantages of the invention will appear upon reading the following detailed description, with reference to the annexed drawings, in which:

FIG. 8 shows a schematic, transverse cross-section of a flexible decoration for decorating a timepiece, particularly for forming a dial according to the invention, or for covering a dial according to the invention shown in cross-section in FIG. 9, the assembled unit being shown in cross-section in FIG. 10.

FIG. 11 shows a schematic, transverse cross-section of the two components of a reinforced dial according to the invention, with a rigid sole that can be housed in a peripheral groove of the dial.

FIG. 12 shows a schematic, transverse cross-section of the two components of another reinforced dial wherein the flexible dial comprises clip pins to be clipped into the orifices of a rigid sole.

FIG. 13 shows a schematic, transverse cross-section of a variant of the flexible dial duplicate moulded onto a rigid sole.

DETAILED DESCRIPTION OF PREFERRED EMBODIMENTS

Figure 1:
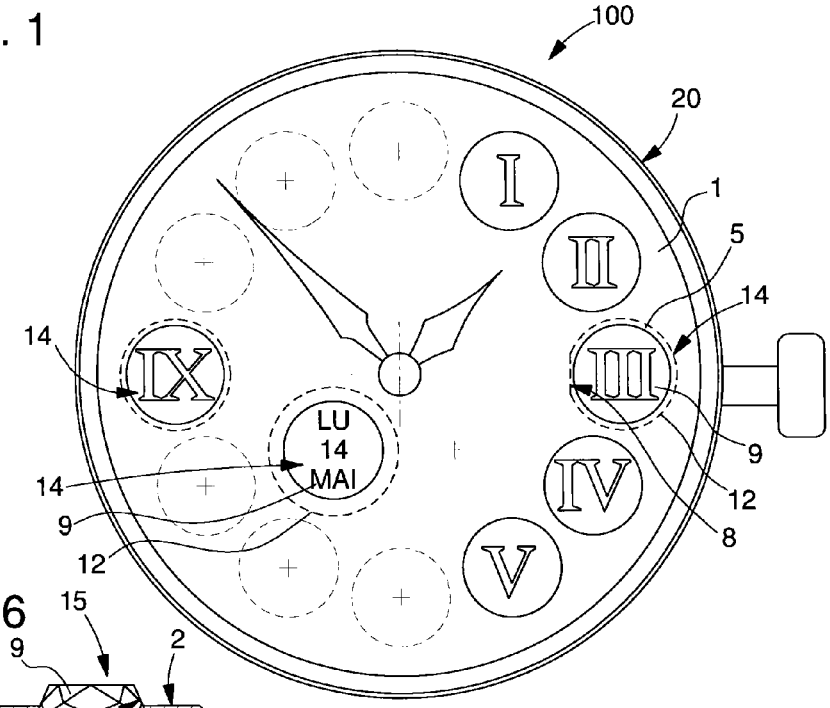
FIG. 1 shows a schematic, front view of a timepiece, in this case a watch, including a dial according to the invention, in a variant wherein the dial is an equipped dial provided with inserts.

The invention concerns the field of timepieces, and more specifically the field of display or the field of decorating visible surfaces.

The invention proposes to allow freedom of design for the dials, by allowing relief portions with undercuts. In a particular variant, this type of dial is made in a single piece. In other variants, the undercuts are used for particular functions, particularly for housing complementary display elements, which may be static or dynamic, such as an independent mechanical movement or an LCD, LED or other electronic display, or for the housing of decorative jewellery elements or similar.

The dial according to the invention is a flexible dial, with at least one hollow relief, or 3D relief with hollow and projecting relief portions, made of flexible material such as elastomer, silicon, rubber or similar.

This dial is a dial 1 for a timepiece 100 comprising a front face 22 forming a visible display surface opposite a back face 3.

According to the invention, this dial 1 includes:

at least one cavity 4 extending into at least one portion of the thickness of dial 1 between visible surface 2 and back face 3, and/or at least one peripheral surface 40 extending into at least one portion of the thickness of dial 1 between visible surface 2 and back face 3.

As seen in FIGS. 2, 3, 4A, 4B and 6, this cavity 4 includes at least one undercut surface 5 extending into at least one portion of the thickness of dial 1 between visible surface 2 and said back face 3.

According to the invention, this dial 1 is in a single piece and made of flexible material selected from among a flexible elastomer or silicon or rubber or leather, or similar flexible materials, as used in horology, jewellery or leather goods.

In a variant seen in FIGS. 8 to 10, dial 1 includes at least one peripheral surface 40 which includes at least one undercut surface 5 extending into at least one portion of the thickness of dial 1 between visible surface 2 and back surface 3.

It is clear that the different variants of the invention also cover a dial with only at least one cavity 40, a dial with only at least one peripheral surface 40, or a dial with both at least one cavity 4 and at least one peripheral surface 40.

In a particular embodiment appropriate for manufacture by moulding, which is inexpensive, quick and reproducible, dial 1 is formed by a flexible elastomer or silicon.

Thus, at least one cavity 4 or at least one peripheral surface 40 includes at least one undercut surface 5, extending into at least one portion of the thickness of dial 1 between visible surface 2 and back face 3. A preferred variant, wherein said undercut surface 5 extends from front face 2, is illustrated by the embodiments of FIGS. 2, 3, 4A, 9, 10, and 13.

In another variant, at least one undercut surface 5 extends from back face 3, as seen in FIGS. 11 and 12.

Naturally, the invention also permits undercut surfaces 5 to be created on any level of dial 1, and not only on the front face 2 or back face 3 thereof, which form particular, non-limiting variants of the invention.

In a particular embodiment, dial 1 is made in a single piece in a flexible moulded material.

Figure 4A:
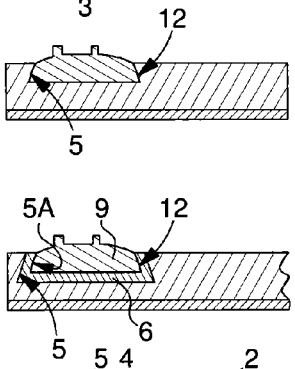
FIG. 4A shows a partial view similar to FIG. 3 of a variant wherein an insert is housed inside a sleeve, which is in turn housed in a cavity in the dial according to the invention on a undercut surface, FIG. 4B showing a variant wherein the sleeve comprises an undercut surface for holding the insert, but wherein the external profile thereof has straight generator lines for the insertion thereof into any dial.
Figure 4B:
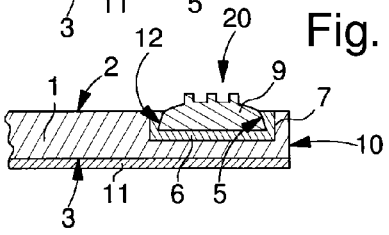
Figure 2:
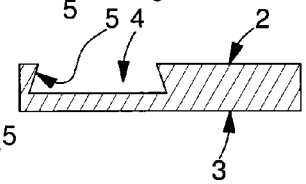
FIG. 2 shows a schematic, partial transverse cross-section of a section of a flexible dial used as the base for the equipped dial of FIG. 1, and comprising an undercut surface for receiving an insert.

In the embodiment of FIG. 4A or 4B, at least one undercut surface 5 is located in a cavity 4 comprised in a flexible or rigid sleeve 6 inserted into a housing 7 extending into at least one portion of the thickness of dial 1 between visible surface 2 and back face 3. FIG. 4A illustrates a preferred variant wherein an insert 9 comprising a tapered surface 12 is housed, on an undercut surface 5A, in a sleeve 6 which also has an outer tapered surface and which is in turn housed in a cavity 4 in dial 1 on an undercut surface 5.

FIG. 4B shows a variant wherein sleeve 6 has an undercut surface 5 for holding insert 9 on a tapered surface 12 thereof, but wherein the external profile of sleeve 6 has straight generator lines for the insertion thereof into any dial. It is easy to understand that, although the invention is advantageously applied to a complete dial, it is also applicable to an isolated component, such as a sleeve 6.

Figure 3:
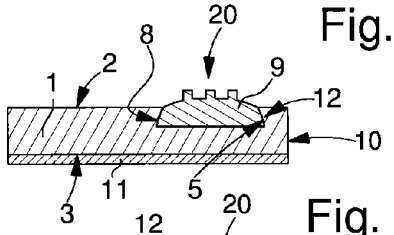
FIG. 3 shows a schematic, transverse cross-section of the equipped dial of FIG. 1 along a nine o'clock-three o'clock axis, provided with two inserts, one which is not indexed for displaying the numeral nine, and the other comprising an angular indexing surface for displaying the numeral three.
Figure 5:
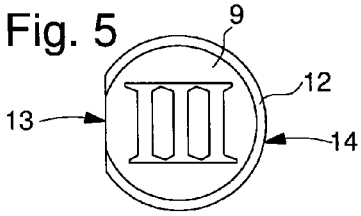
FIG. 5 shows a schematic top view of the insert for the numeral three of FIG. 1, which includes an orientation surface arranged to cooperate in a complementary manner with an indexing surface comprised in the corresponding cavity of the dial.

Advantageously, for optimum angular positioning of an insert 9, at least one undercut surface 5 of dial 1 is located in a cavity 4 of this type, which includes an indexing surface 8 for the unique angular orientation of an insert 9, which includes an orientation surface 13 arranged to cooperate in a complementary manner with said indexing surface 12 as seen in FIGS. 1, 3 and 5. This therefore removes the risk of a display sign being shown the wrong way round, for example IX instead of XI.

In addition to a bare dial 1, the invention also concerns a reinforced dial 10 comprising at least one dial 1, reinforced by at least one rigid sole 11. In the preferred variant of FIGS. 3, 4A, 4B, 9 and 10, at least one back face 3 of the dial is secured to a rigid sole 11. It may be secured during the production of dial 10 or subsequently by bonding or similar. FIG. 13 illustrates an example wherein the reinforced dial 10 results from the duplicate moulding of a dial 1 on a rigid sole 11.

FIGS. 11 and 12 illustrate two variants of reinforced dial 10: dial 1 of FIG. 11 includes an at least partially peripheral groove 16, comprising an undercut surface 5 for receiving an edge 111 of a rigid sole 11, for holding one securely in position in relation to the other. In FIG. 12, dial 1 includes at least one clip pin 17 comprising an undercut surface 5, for holding dial 1 clipped in at least one orifice 110 comprised in rigid sole 11 opposite said at least one clip pin 17.

The invention also concerns an equipped dial 20 including at least one dial 1 or one reinforced dial 10 of this type. This equipped dial 20 includes at least one flexible or rigid insert 9. This insert 9 includes at least one tapered surface 12 cooperating with an undercut surface 5 for holding insert 9 in at least one dial 1 or 10 as appropriate.

In a particular variant of equipped dial 20, at least one insert 9 is rigid. This insert 9, which carries a display element or a decorative element, and has a small front surface, can be made in a more luxurious material than dial 1 itself, for example, porcelain, crystal, precious metal or a gem. The illustrated example proposes display inserts 9 with numerals in relief and comprising a coating such as gilding, which may be separately prepared. The easy positioning of the display inserts may be made even easier by the presence of an angular mark such as a flat portion in flexible dial 1 and in insert 9, which means that an elaborate dial can easily be produced on request. Thus, when at least one insert 9 has to be positioned in a particular manner, it has an orientation surface 13 arranged to cooperate in a complementary manner with an indexing surface 8 comprised in a cavity 4, which has an undercut surface 5, for the housing and unique angular orientation of said insert 9.

Figure 6:
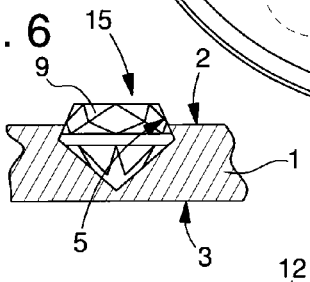
FIG. 6 shows a schematic, partial, transverse cross-section of a section of a flexible dial according to the invention, fitted with an insert which is a jewellery component (shown in elevation in FIG. 7).
Figure 7:
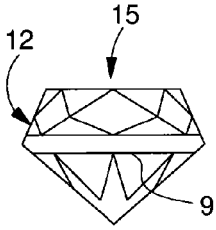

On an equipped dial 20 of this type, at least one insert 9 is a static display component 14, like the numerals of FIGS. 1, 3, 4A, 4B and 5, or a dynamic display component 14, which may be an independent mechanical movement, or, as seen in FIG. 1 at seven o'clock, an LCD, LED or other electronic display. This insert 9 may also be formed by an energy sensor, particularly a solar sensor or by a physical magnitude or barometric sensor, for example. Insert 9 may also include at least one jewellery component 15 or similar, as illustrated in FIGS. 6 and 7.

FIGS. 8 to 10 illustrate the decoration of the visible surfaces of a timepiece, particularly of a watch, with a flexible covering such as leather or similar. FIG. 8 shows a flexible covering 90, particularly for forming the visible surface of a dial 1 according to the invention, or for covering a dial 1 according to the invention. On an equipped dial 20 comprising a dial 1 according to the invention and/or a covering 90, at least one dial 1 has at least one peripheral surface 40, at least one undercut surface 5 of which holds a covering 90 which covers the front face 2 of said dial 1.

In a preferred embodiment, covering 90 is flexible and includes a peripheral lip 92 delimited by a nicked groove 91 and an edge 93. The peripheral surface 40 of dial 1 is delimited on a front side by an edge 43 between the front fact 2 and the undercut surface 5, and on a back side by a peripheral edge 41 marking a peripheral groove 42 arranged to hold said edge 93 when notch 91 cooperates with edge 43 and when the peripheral lip 42 is folded down onto the peripheral surface 40, as seen in FIG. 10. In this variant, the material selected for covering 90 of dial 1 is not only flexible, but also easily extendible, along a travel sufficient to allow it to pass over edge 43 and to be folded down and wedged underneath peripheral lip 42.

In an alternative embodiment, covering 90 is rigid, and includes a peripheral lip 92 delimited by a nicked groove 91 and an edge 93. The peripheral surface 40 of dial 1 is delimited on a front side by an edge 43 between front face 2 and undercut surface 5, and on a back side by a peripheral edge 41 marking a peripheral groove 42 arranged to hold edge 93 when covering 90 is clipped onto dial 1, said notch 91 cooperating with edge 43 and peripheral lip 42 abutting on the peripheral surface 40.

In a preferred embodiment of equipped dial 20, at least one dial 1 comprising an undercut surface 5 is made of silicon or a flexible elastomer.

The invention also concerns a timepiece 100 including at least one dial 1 or reinforced dial of this type, or an equipped dial 20 of this type.

The invention also concerns a method of making a dial 1 of this type, wherein:

- a mould is prepared comprising at least one relief surface including at least one undercut surface;
- a flexible material or silicon or flexible elastomer is moulded in a liquid or paste state in said mould;
- said flexible material or silicon or flexible elastomer is left in said mould for a sufficient time to achieve polymerisation or vulcanisation until an ambient temperature stable dial is obtained;
- the dial is removed from the mould.

It is possible to remove warped shapes and even undercut shapes from the mould owing to the use of a material which is flexible in ambient conditions of use of the watch. In a particular variant, the method is implemented to obtain a flexible relief dial duplicate moulded on at least one rigid sole 11. The rigid sole or base provides advantageous stability. To achieve this:

- a mould is prepared comprising at least one relief surface including at least one undercut surface, and at least one rigid sole is inserted therein;
- a flexible material or silicon or flexible elastomer is moulded in a liquid or paste state in said mould, overmoulded on said at least one rigid sole.

The invention resolves the problem of manufacturing a dial with complex shapes in sunken or raised relief, and proposes an elegant, cheaper solution.

It enables a dial to be made with undercut areas having a determined profile of perfectly precise geometry.

The invention also permits the creation of numerous variants by personalised combinations of inserts housed in the undercut areas. It also permits, in particular, the display of letters or numerals in different languages or fonts, or symbols pertaining to certain civilisations, without altering the basic movement and a basic dial 1.

What is claimed is:

1. A timepiece comprising;

a reinforced dial including a rigid sole at a bottom back side; and at least one upper dial at a top side, said upper dial including a front face which forms a visible display surface and is opposite a back face, at least one cavity extending into at least one portion of a thickness of said upper dial between said visible surface and said back face, and at least one undercut surface extending into at least one portion of the thickness of said upper dial between said visible surface and said back face, wherein said upper dial is a single piece made of flexible material selected from among materials including a flexible elastomer, silicon, rubber, and leather, and wherein at least one back face is secured to said rigid sole.

2. The timepiece according to claim 1, wherein said upper dial further includes at least one peripheral surface extending into at least one portion of the thickness of said dial between said visible surface and said back face, and wherein said at least one peripheral surface comprises at least one undercut surface, extending into at least one portion of the thickness of said upper dial between said visible surface and said back face.

3. The timepiece according to claim 1, wherein said upper dial is formed by a flexible elastomer or silicon.

4. The timepiece according to claim 1, wherein at least one undercut surface is located in a said cavity comprised in a flexible or rigid sleeve inserted in a housing extending into at least one portion of the thickness of said upper dial between said visible surface and said back face.

5. The timepiece according to claim 1, wherein at least one undercut surface is located in a said cavity which includes an indexing surface for the unique angular orientation of an insert.

6. The timepiece according to claim 5, wherein said upper dial comprises a groove including one said undercut surface for receiving an edge of said rigid sole.

7. The timepiece according to claim 1, wherein said upper dial includes at least one clip pin comprising one said undercut surface for holding said upper dial clipped into at least one orifice comprised in said rigid sole opposite said at least one clip pin.

8. The timepiece according to claim 1, wherein said reinforced dial is an equipped reinforced dial comprising at least one of said upper dial, wherein said upper dial includes at least one flexible or rigid insert and comprising at least one tapered surface cooperating with a said undercut surface to hold said insert in said at least one upper dial.

9. The timepiece according to claim 8, wherein said insert comprising a said tapered surface is housed, on an undercut surface, in a sleeve which also has an outer tapered surface and which is in turn housed in a said cavity of said upper dial on a said undercut surface.

10. The timepiece according to claim 8, wherein at least one said insert is made of elastomer or silicon.

11. The timepiece according to claim 8, wherein at least one said insert is rigid.

12. The timepiece according to claim 11, wherein said insert is a static or electronic display component.

13. The equipped dial timepiece according to claim 8, wherein said insert is a jewellery component.

14. The timepiece according to claim 8, wherein at least one said insert has an orientation surface arranged to cooperate in a complementary manner with an indexing surface comprised in a said cavity which comprises a said undercut surface, for the housing and unique angular orientation of said insert.

15. The timepiece according to claim 8, wherein at least one said upper dial has at least one peripheral surface wherein at least one said undercut surface holds a covering which covers said front face of said upper dial.

16. The timepiece according to claim 15, wherein said covering is flexible and includes a peripheral lip delimited by a nicked groove and an edge, and wherein said peripheral surface of said upper dial is delimited on a front side by an edge between said front face and said undercut surface and on a back side by a peripheral edge marking a peripheral groove arranged to hold said edge when said nicked groove cooperates with said edge and when said peripheral lip is folded down and abuts on said peripheral surface.

17. The timepiece according to claim 15, wherein said covering is rigid and includes a peripheral lip delimited by a nicked groove and an edge, and wherein said peripheral surface of said upper dial is delimited on a front side by an edge between said front face and said undercut surface, and on a back side by a peripheral edge marking a peripheral groove arranged to hold said edge when said covering is clipped onto said upper dial, said nicked groove cooperating with said edge and said peripheral lip abutting on said peripheral surface.

18. The equipped dial timepiece according to claim 8, wherein at least one said upper dial comprising one said undercut surface is made of silicon or a flexible elastomer.

19. A method of making a reinforced dial comprising:

preparing a mold that includes at least one relief surface including at least one undercut surface, and at least one rigid sole is inserted therein;

molding a flexible material or silicon or flexible elastomer in a liquid or paste state in said mold, over-molded on said at least one rigid sole;

said flexible material or silicon or flexible elastomer is left in said mold for a sufficient time to achieve polymerisation or vulcanisation until an ambient temperature stable upper dial is obtained; and said reinforced dial is removed from the mold.

* * * * *